United States Patent [19]

Hare

[11] 4,419,556

[45] Dec. 6, 1983

[54] EXTENSION CONTROL DEVICE AND TUBING MEMBER FOR CONTROLLING SWITCH ACTUATION

[76] Inventor: Patrick H. Hare, 2027 Que St., NW., Washington, D.C. 20009

[21] Appl. No.: 344,036

[22] Filed: Jan. 29, 1982

[51] Int. Cl.[3] ..... H01H 3/20

[52] U.S. Cl. ..... 200/331; 16/DIG. 13

[58] Field of Search ..... 200/331; 74/554; 16/225, DIG. 13; 403/223, 302, 313

[56] References Cited

U.S. PATENT DOCUMENTS

| | | | |
|---|---|---|---|
| 2,389,220 | 11/1945 | Tredeau | 200/331 |
| 2,461,614 | 2/1949 | Seaman | 200/331 |
| 2,466,820 | 4/1949 | Oberschmidt | 200/331 |
| 2,493,581 | 1/1950 | Hood | 74/503 |
| 2,580,905 | 1/1952 | Foster | 200/331 |
| 2,582,379 | 1/1952 | Goldberg | 200/331 |
| 2,668,456 | 2/1954 | Meistrell | 74/503 |
| 2,692,932 | 10/1954 | Parke et al. | 200/331 |
| 2,719,898 | 10/1955 | Allen | 200/331 |
| 2,724,032 | 11/1955 | Coletta | 200/331 |
| 2,726,303 | 12/1955 | Berndsen | 200/331 |
| 2,760,035 | 8/1956 | Friesen | 200/331 |
| 2,775,674 | 12/1956 | Meder | 200/331 |
| 2,848,585 | 8/1958 | Atkin | 200/331 |
| 2,919,334 | 12/1959 | Jones | 200/331 |
| 3,004,128 | 10/1961 | Mikolajeski | 200/331 |
| 3,121,778 | 2/1964 | Sander et al. | 200/331 |
| 3,142,744 | 7/1964 | Keck | 200/331 |
| 3,159,048 | 12/1964 | Clifford | 74/491 |
| 3,175,420 | 3/1965 | Craig | 74/544 |
| 3,177,883 | 4/1965 | Militano | 16/225 X |
| 3,188,439 | 6/1965 | Fullerton | 200/331 |
| 3,339,051 | 8/1967 | De Vall | 200/331 |
| 3;388,611 | 6/1968 | Clary et al. | 16/225 X |
| 3,581,037 | 5/1971 | Schiffelbein | 200/331 |
| 3,590,648 | 7/1971 | Gorman | 74/103 |
| 3,613,179 | 10/1971 | Whittaker | 403/313 X |
| 3,722,319 | 3/1973 | Reznik et al. | 200/331 X |
| 3,825,710 | 7/1974 | Roberts et al. | 200/331 |
| 3,839,615 | 10/1974 | Bradford | 200/331 |
| 3,853,366 | 12/1974 | Kesling et al. | 16/DIG. 13 |
| 3,892,935 | 7/1975 | Patterson | 200/331 |
| 3,916,134 | 10/1975 | Hansen | 200/331 |
| 4,256,943 | 3/1981 | Whitlock | 200/331 |

*Primary Examiner*—Stephen Marcus
*Assistant Examiner*—Renee S. Kidorf
*Attorney, Agent, or Firm*—Fleit, Jacobson, Cohn & Price

[57] ABSTRACT

An extension control device and a tubing member usable therewith for use with a wall-mounted toggle switch assembly having a switch with a protruding lever. The control device has an elongated member with a lower or distal end portion graspable by a user of the device and a tubing member connected to an upper end portion of the elongated member. The tubing member has a proximal end with two spaced apart pronged portions protruding from a hollow tubular portion. The switch lever is insertable into the hollow tubular portion so that the hollow tubular portion releasably grips the switch lever. Should the cavity of the tubular portion be greater than the exterior circumference of the switch lever, one or both of the pronged portions are inserted into the cavity to reduce its dimensions. Alternatively, the tubing member has a flat proximal end, and all or a portion of a split ring is insertable into the internal cavity of the tubing member to reduce its size. In both versions, a notch portion is formed in the tubing member intermediate its ends so that an upper portion of the tubing member is angularly movable with respect to a lower portion of the tubing member. Up and down movement of the elongated member results in corresponding movement of the lower portion of the tubing member so that the upper portion is angularly moved to thereby move the switch between on and off positions. The invention further provides a method of making the tubing member used with the extension control device.

11 Claims, 6 Drawing Figures

EXTENSION CONTROL DEVICE AND TUBING MEMBER FOR CONTROLLING SWITCH ACTUATION

BACKGROUND OF THE INVENTION

1. Field of the Invention

The present invention relates to an extension control device for a wall-mounted toggle switch. More particularly, the invention relates to a control device which permits access to the wall mounted switch by an elongated member hanging from the switch. The invention further provides a tubing member and a method of making a tubing member usable with the extension control device.

2. Description of the Prior Art

Extension control devices for wall mounted switches are already known in the prior art and have been disclosed in various configurations. Such devices are designed to allow operation of the switch by small children and others incapable of reaching the switch. Generally speaking, such previously known devices include a switch engaging member either releasably or permanently connected to a switch lever of a wall-mounted toggle switch assembly and a device hanging below the switch engaging member for controlling movement of the switch engaging member to thereby move the switch lever between "on" and "off" positions.

Desirable requirements of an extension control device include:

a. ease of connection to switch levers having varying external dimensions;
b. reduction of possibility of damage of the control device and the switch lever when the device is subjected to abusive handling;
c. prevention of damage to both the wall located lower than the toggle switch assembly and to the toggle switch assembly from use of the extension control device;
d. ease of fabrication and assembly of the extension control device; and
e. ease of connection to switch levers without any positive connection to switch plates or need to modify or replace existing switch plates.

SUMMARY OF THE INVENTION

Accordingly, it is an object of the present invention to provide an improved extension control device for a wall-mounted toggle switch assembly having a protruding switch lever.

The present invention provides a device for controlling the operation of a switch lever which provides the desirable requirements set forth previously. Such device is designed to eliminate or significantly reduce complex machining and forming operations during fabrication. The device is convenient to install and remove since it requires no separate mechanisms for securing the tubing member of the device to the switch plate. In addition, the nature of the construction of the device and the materials used to construct the device allow some degree of abusive handling without risk of damage to either the device or the switch lever.

One embodiment of the present invention provides an extension control device having a pull rod or an elongated member with a distal end portion designed to be grasped by a user of the extension control device. A distal end portion of a tubing member is connected to the proximal end of the elongated member or to a portion closely spaced from the end of the elongated member. A proximal end portion of the tubing member is designed to engage a switch lever. In one embodiment, the tubing member is so shaped that the size of an internal cavity of the tubing member that grips the switch lever is varied by folding one or more protruding portions of the tubing member into the internal cavity before the switch lever is inserted into the internal cavity. In another embodiment, a separate insert is positioned in the internal cavity. Preferably, the insert is carried by the handle so that it is readily available for use. With the first embodiment, the switch lever is inserted between the pronged portions into the hollow tubular portion so that the hollow tubular portion releasably grips the switch lever. Should the external configuration of the switch lever be less than the internal diameter of the hollow tubular portion, one or both of the pronged portions are folded inwardly into the interior of the hollow tubular portion to thereby reduce its internal cavity so that switch levers of varying sizes can be securely grasped and retained within the cavity.

The tubular member has a notched portion intermediate its ends that defines a hinge so that a portion of the tubing member above the notched portion is angularly movable with respect to a portion of the tubing member below the notched portion. The upper portion is connected to the switch lever and the lower portion is connected to the elongated member so that up and down movement of the elongated member moves the upper portion to thereby control movement of the switch lever.

In the second embodiment of the tubing member, the proximal end portion of the tubing member that engages the switch lever is a cylindrical member without pronged portions. a separate insert is positioned inside the cylindrical member to reduce the size of its internal cavity so that the tubing member securely grips the switch lever. Preferably, the insert is part or all of a split tubular ring that is positioned on the pull rod of the extension control device. The user merely removes the ring from the pull rod, cuts off an insert of appropriate size, and positions the insert in the internal cavity of the hollow cylindrical end portion. If necessary, the entire ring can be positioned inside the internal cavity.

Both embodiments of the previously described tubing member are provided in the form of a hollow tubular member that is connected coaxially with the elongated member. Alternatively, the tubing members have collars formed in their lower portions for engaging a portion of the pull rod or elongated member spaced from its proximal end. A decorative member, such as a flower, is connected to the proximal end of the elongated member.

The invention also provides a method of forming the tubing member used with the extension control device. The method includes cutting a predetermined length of tubing member, cutting generally rectangular notches in opposite sides of one end of the tubing member to thereby form protruding spaced apart pronged portions, and notching the tubing member intermediate its ends to form a hinge that permits relative angular movement between an upper portion of the tubing member and a lower portion of the tubing member. An optional step of the method involves the cutting of the lower portion of the tubing member to form a collar for receiving an elongated member that is connected to the tubing member to form the extension control device.

The invention further provides a tubing member for engaging a switch lever protruding from a wall-mounted toggle switch assembly. The tubing member has two spaced apart pronged portions protruding from a hollow proximal end portion, with each of the pronged portions being movable between a position inside the hollow proximal end and a position in which the pronged portion is exterior of the periphery of the proximal end. A notched portion is provided intermediate the ends of the tubing member to form a hinge so that an upper portion of the tubing member is angularly movable with respect to a lower portion. The tubing member is formed by performing a series of cutting operations on a length of tubing or is a molded fitting.

The invention, and its objects and advantages, will become more apparent in the detailed description of the preferred embodiments hereinafter presented.

BRIEF DESCRIPTION OF THE DRAWINGS

In the detailed description of the preferred embodiments of the invention hereinafter presented, reference is made to the accompanying drawings, in which.

DESCRIPTION OF THE PREFERRED EMBODIMENTS

Figure 1:
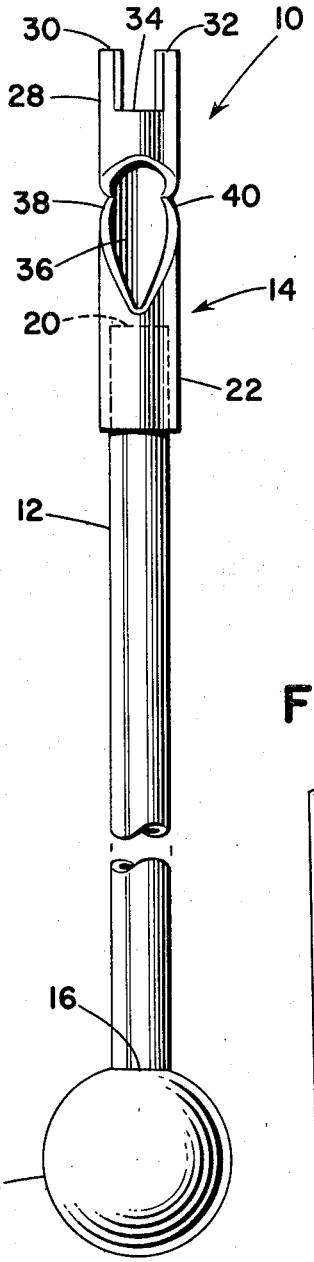
FIG. 1 is a front view of one embodiment of an extension control device according to the present invention.

The present description will be directed in particular to elements forming part of, or cooperating more directly with, the present invention. Elements not specifically shown or described herein are understood to be selectable from those known in the art.

Referring now to the drawings, and to FIGS. 1 to 5 in particular, one embodiment of an extension control device according to the present invention is illustrated. The extension control device, which is generally designated 10, includes an elongated member 12 and a tubing member, generally designated 14.

A distal end 16 of the elongated member 12 is enlarged or connected to a handle member 18 designed to be grasped by a user of the control device. It should be appreciated that the end 16 can be connected to an exterior surface of the handle member or can protrude into the interior of the handle member to provide a more secure connection. The proximal end 20 of the member 12 is received within the hollow tubular distal end 22 of the tubing member 14. Preferably, the tubing member 14 is formed of a relatively flexible material that is less rigid than the material forming the elongated member 12 so that distal end 22 can be deformed to securely grip the proximal end 20.

Figure 2:
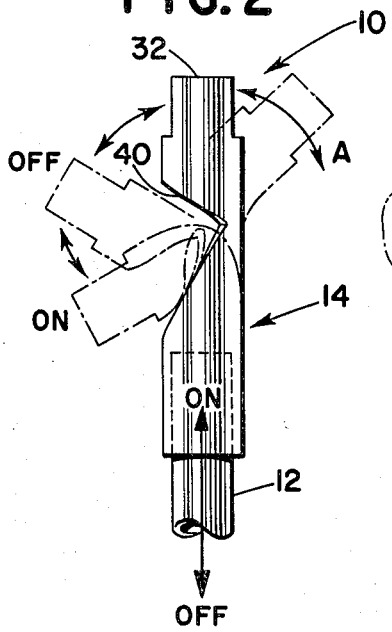
FIG. 2 is a side view of an upper portion of the extension control device illustrated in FIG. 1.

The tubing member 14, as best illustrated in FIGS. 1 and 2, has a proximal end 28 with spaced apart tabs or pronged portions 30 and 32 protruding from a hollow cylindrical portion or cavity 34. Surprisingly, it has been found that increasing the distances between the tabs at their free ends seems to provide a stronger grip of the light switch. A notched portion 36 is provided in the tubing member 14 intermediate its ends to form a hinge so that a portion of the tubing member above the notch 36 is angularly movable with respect to a portion of the tubing member located below the notch. Preferably, the tubing member is formed of a relatively flexible plastic to facilitate movement about the hinge. A narrower hinge also seems to contribute to enhanced gripping of the light switch. The angles of the notch, as illustrated in FIG. 2, appear to be important to proper functioning.

The tubing member is relatively easy to form by well known molding techniques. Alternatively, the tubing member is formed by cutting two generally rectangular notches in opposite sides of one end of the tubing to form the pronged portions 30 and 32. The notched portion 36 is formed by making two triangular-shaped cuts in the intermediate portion of the tubing member thereby providing triangular-shape side edges 38 and 40. A line connecting the apices of the side edges 38 and 40 extends parallel to a plane passing through the midpoints of the pronged portions 30 and 32.

The notched portion 36 acts as a "living hinge" so that the upper portion of the tubing member is movable between the phantom line positions illustrated in FIG. 2. In the position designated "A," the upper end is bent to facilitate application of the tubing member to a switch lever. Should difficulty be encountered while putting the tubing member onto the switch lever, the upper portion is moved into the position "A" so that finger pressure can be applied to the edge of the notch portion 36 closest to the pronged portions 30 and 32. The position designated "OFF" is the position of the tubing member corresponding to the "OFF" position of the switch lever. Similarly, the position "ON" is the position of the tubing member corresponding to the "ON" position of the switch lever. When the elongated member 12 is moved in the direction of the arrowhead designated "ON," upward movement of the lower portion of the tubing member 14 results in pivoting of the upper portion from the "OFF" position to the "ON" position. Similarly, downward movement of the elongated member 12 results in moving the switch lever to its "OFF" position. It should be readily appreciated that the "OFF" and "ON" positions are interchangeable with each other.

Figure 3:
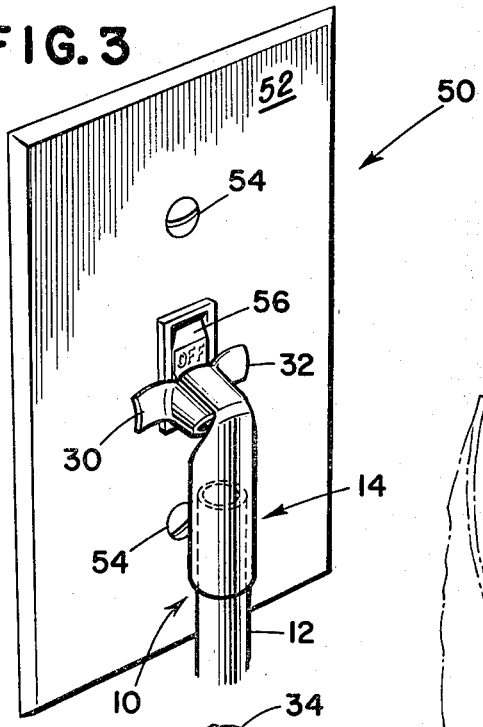
FIG. 3 is a perspective of the extension control device of FIG. 1 applied to a protruding switch lever of a wall-mounted toggle switch assembly, with the tubing member of the device having a first configuration.

Referring now to FIG. 3, use of the extension control device 10 is illustrated. FIG. 3 illustrates a conventional wall-mounted toggle switch assembly, generally designated 50, that has a face plate 52 connected by screws 54 to a switch box (not shown) located within a wall. A switch lever 56 has a portion thereof protruding outwardly from the plane of the face plate 52. Initially, it is preferable to clean the lever 56 with a suitable solvent to enhance the frictional engagement between the lever and the tubing member. When the external circumference of the protruding portion of the switch lever 56 is equal to or slightly greater than the interior cavity 34 of the tubing member, the pronged portions 30 and 32 are positioned as illustrated in FIG. 3. In such position, there is sufficient frictional contact between walls of the cavity and the switch lever to securely connect the tubing member to the switch lever.

Figure 4:
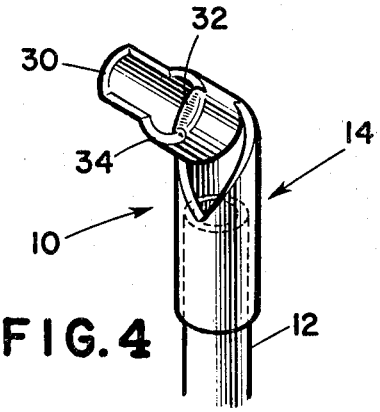
FIG. 4 is a perspective of an upper portion of the extension control device illustrated in FIG. 1, with the tubing member having a second configuration.
Figure 5:
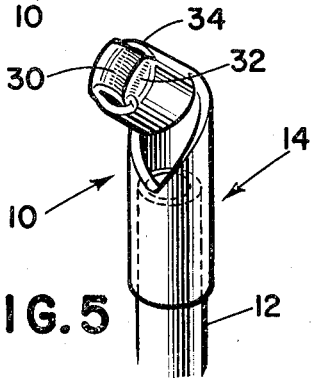
FIG. 5 is a view similar to FIG. 4 with the tubing member having a third configuration.

Should the external periphery of the switch lever be smaller than the cavity 34, one of the pronged portions, for instance pronged portion 32 as illustrated in FIG. 4, is inserted into the interior of the cavity to thereby reduce its size. Should the external periphery of the switch lever 56 be even smaller, than both of the pronged portions 30 and 32 are positioned within the cavity 34 to provide a cavity of significantly reduced size, as illustrated in FIG. 5. Accordingly, the pronged portions 30 and 32 greatly enhance the flexibility of the control device 10 by facilitating a secure, but releasable, connection between the tubing member 14 and switch levers having varying external dimensions.

Figure 6:
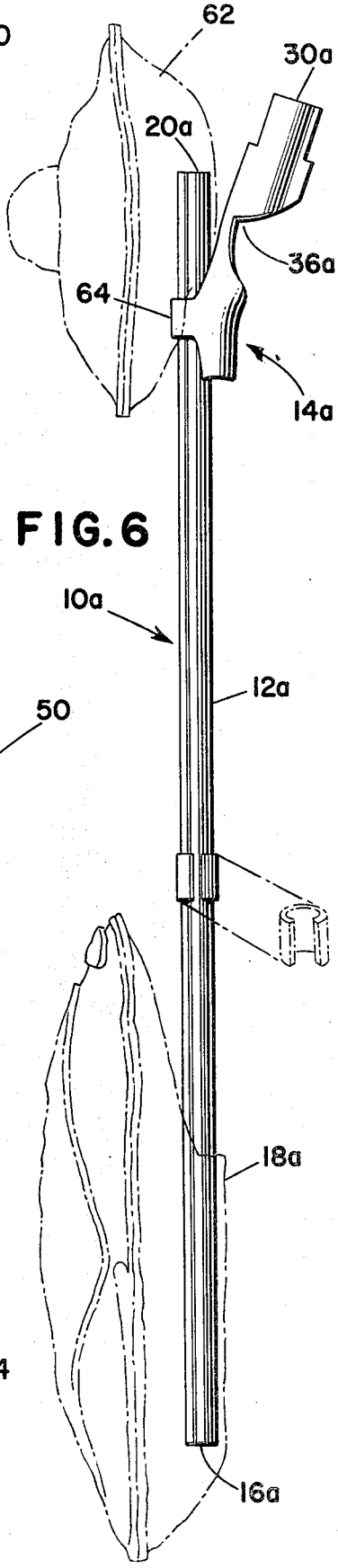
FIG. 6 is a side view of a modified embodiment of the extension control device illustrated in FIG. 1.

Referring now to FIG. 6, a modification of the embodiment illustrated in FIG. 1 is illustrated. Components of the device similar to those previously discussed are identified with the previously used reference numerals, followed by the suffix "a."

The extension control device 10*a* illustrated in FIG. 6 has an elongated member 12*a* with a distal end 16*a* protruding into a pocket formed on the back of a handle member 18*a*. Similarly, the proximal end 20*a* of the elongated member 12*a* extends into a pocket of a decorative member, figure, or element 62. For instance, FIG. 6 schematically illustrates a flower 62.

The tubing member 14*a*, like the tubing member 14, has a notched portion 36*a*. the end 30*a* of the tubing member 14*a*, however, is flat. There are no protruding tabs or pronged portions similar to the members 30 and 32. With this embodiment, a separate insert is used with the internal cavity of the tubular member is too large to securely grip the light switch. FIG. 6 illustrates a split tubular ring 70 positioned on the rod 12*a*. As illustrated in phantom, the ring 70 is removable from the rod 12*a* to provide material for the insert. If the light switch is extremely small, the entire ring is inserted into the internal cavity of the tubing member 14*a*, If there is a loose fit between the switch and tubing member, a portion of the ring 70 is cut-off to form an appropriately sized insert for reducing the size of the internal cavity so that a tight fit is provided between the switch and end portion 30*a* of the tubing member. Thus, the split ring 70 and tubing member 14*a* form a composite tubing member assembly for gripping a light switch, the assembly being adjustable to compensate for variations in the size of a switch to be gripped.

The embodiment of FIG. 6 also differs from that of FIGS. 1 to 5 in that two parallel cuts are made in a lower portion of the tubing member 14*a* to define a collar 64. The elongated member 12*a* is inserted through the collar 64 so that its proximal end 20*a* protrudes a sufficient distance to provide support for the decorative member 62. While it is possible to use only a friction fit between the collar 64 and elongated member 12*a*, it is preferable to use an adhesive, welding, or other suitable methods to interconnect the two members.

Previously, specific embodiments of the present invention have been described. It should be appreciated, however, that these embodiments have been described for the purposes of illustration only, without any intention of limiting the scope of the present invention. For instance, the handle member or enlargement 18 can take numerous shapes, such as a rubber ball or a stuffed animal, such as a frog. Also, the tubing member of FIGS. 1 to 5 can be connected to the elongated member in the manner illustrated with the embodiment of FIG. 6, and the tubing member of FIG. 6 can be connected to the elongated member in the manner illustrated in FIGS. 1 to 5. Accordingly, it is the intention that the present invention be limited only by the appended claims.

What is claimed is:

1. An extension control device for use with a wall-mounted toggle switch assembly having a switch with a protruding lever comprising:

a. an elongated member having a proximal end portion and a distal end portion graspable by a user of the extension control device; and b. a tubing member connected to a portion of said elongated member in the vicinity of the proximal end thereof, said tubing member having:

1. a distal end portion connected to the elongated member, 2. a proximal end portion defining means for engaging a switch lever and having two spaced apart pronged portions protruding from a hollow tubular portion, the switch lever being insertable between the pronged portions into the hollow tubular portion so that the hollow tubular portion releasably grips the switch lever, one of said pronged portions being insertable into said hollow tubular portion prior to insertion of the switch lever to thereby reduce the interior cavity of said hollow tubular portion so that the hollow tubular portion releasably grips the switch lever is a secure manner, and 3. a notched portion defining a hinge intermediate said tubing member distal end portion and said tubing member proximal end portion so that an upper portion of said tubing member above said notched portion is angularly movable with respect to a lower portion, the lower portion extending substantially vertically when the tubing member is engaged with a switch lever and the upper portion extending skewed to the lower portion whereby up and down movement of said elongated member moves said upper portion to thereby control movement of said switch lever.

2. An extension control device according to claim 1, wherein both of said pronged portions are insertable into said hollow tubular portion prior to insertion of the switch lever to thereby reduce the interior cavity of said hollow tubular portion so that the hollow tubular portion releasably grips the switch lever in a secure manner.

3. An extension control device according to one of claims 1 or 2, wherein said tubing member is connected to said elongated member at a location spaced from the proximal end of said elongated member, said extension control device further comprising a decorative member encompassing the proximal end of said elongated member.

4. An extension control device according to one of claims 1 or 2, wherein the tubing member notched portion is formed by angular notches extending into the tubing member, a line connecting the apices of the angular notches being perpendicular to an axis of the tubing member.

5. An extension control device for use with a wall-mounted toggle switch assembly having a switch with a protruding lever comprising:

a. an elongated member having a proximal end portion and a distal end portion graspable by a user of the extension control device;

b. a constant diameter tubing member connected to a portion of said elongated member in the vicinity of the proximal end of said elongated member, said tubing member having:

1. a distal end portion connected to the elongated member,
2. a hollow tubular proximal end portion defining means for engaging a switch lever, the switch lever being insertable into an internal cavity of the hollow tubular portion so that the hollow tubular portion releasably grips the switch lever, and
3. a notched portion defining a hinge intermediate said tubing member distal end portion and said tubing member proximal end portion so that an upper portion of said tubing member above said notched portion is angularly movable with respect to a lower portion of said tubing member below said notched portion, the lower portion extending substantially vertically when the tubing member is engaged with a switch lever and the upper portion extending skewed to the lower portion whereby up and down movement of said elongated member moves said upper portion to thereby control movement of said switch lever.

6. An extension control device according to one of claims 1 or 5, wherein said tubing member is a hollow tubular member and said distal end portion of said tubing member is connected coaxially with said elongated member.

7. An extension control device according to claim 5, further comprising a split ring carried by said elongated member, said split ring being removable from said elongated member and at least a portion of said split ring being insertable into said internal cavity of said hollow tubular member to reduce the size of said internal cavity so that the switch lever is tightly gripped.

8. An extension control device according to claim 7, wherein all of said split ring is insertable into the internal cavity.

9. A tubing member for engaging a switch lever protruding from a wall-mounted toggle switch assembly comprising:

two spaced apart pronged portions protruding from a hollow proximal end portion of the tubing member, each of said pronged portions being movable between a first position in which the pronged portion extends inside the hollow proximal end and a second position in which the pronged portion is exterior of the periphery of the proximal end, the switch lever being insertable into the proximal end after movement of the pronged portions; and a notched portion defining a hinge positioned intermediate end of the tubing member so that an upper portion of the tubing member is angularly movable with respect to a lower portion.

10. An extension control device for use with a wall-mounted toggle switch assembly having a switch with a protruding lever comprising:

a. an elongated member having a proximal end portion and a distal end portion graspable by a user of the extension control device; and b. a tubing member connected to a portion of said elongated member in the vicinity of the proximal end thereof, said tubing member having:

1. a distal end portion connected to the elongated member,
2. a proximal end portion defining means for engaging a switch lever and having two spaced apart pronged portions protruding from a hollow tubular portion, the switch lever being insertable between the pronged portions into the hollow tubular portion so that the hollow tubular portion releasably grips the switch lever, and
3. a notched portion defining a hinge intermediate said tubing member distal end portion and said tubing member proximal end portion so that an upper portion of said tubing member above said notched portion is angularly movable with respect to a lower portion of said tubing member below said notched portion, the lower portion extending substantially vertically when the tubing member is engaged with a switch lever and the upper portion extending skewed to the lower portion whereby up and down movement of said elongated member moves said upper portion to thereby control movement of said switch lever said tubing member being connected to said elongated member at a location spaced from the proximal end of said elongated member, said extension control device further comprising a decorative member encompassing the proximal end of said elongated member.

11. An extension control device according to one of claims 3, 5, or 10, wherein said tubing member is a hollow tubular member and has a slitted portion formed in the lower portion thereof defining a collar, said elongated member passing through said collar.

* * * * *